US005687643A

United States Patent [19]

Felts et al.

[11] Patent Number: 5,687,643

[45] Date of Patent: Nov. 18, 1997

[54] METHOD AND APPARATUS FOR PRODUCING A STRAPPED BALE OF COMPRESSED FIBERS

[76] Inventors: J. David Felts, 104 Weston Pl., Asheville, N.C. 28803; Kenneth W. Elliott, 306 Old Country Home Rd., Asheville, N.C. 28806; David P. Zachary, 44 Lochencove Rd., Brevard, N.C. 28712

[21] Appl. No.: 587,221

[22] Filed: Jan. 16, 1996

[51] Int. Cl.[6] ..... B30B 9/30; B65B 27/12

[52] U.S. Cl. ..... 100/3; 100/7; 100/207; 100/215; 100/218; 100/220; 100/244

[58] Field of Search ..... 100/3, 7, 137, 100/193, 207, 215, 218, 220, 244, 264

[56] References Cited

U.S. PATENT DOCUMENTS

| | | | |
|---|---|---|---|
| 828,213 | 8/1906 | Jones et al. | 100/207 |
| 2,209,740 | 7/1940 | Steinhauer . | |
| 3,451,185 | 6/1969 | Tezuka | 100/3 |
| 3,693,541 | 9/1972 | Lombard et al. | 100/3 |
| 4,162,603 | 7/1979 | Strömberg | 53/438 |
| 4,182,237 | 1/1980 | O'Brien | 100/35 |
| 4,476,779 | 10/1984 | Hasebe et al. | 100/3 |
| 4,573,403 | 3/1986 | Van Doorn et al. | 100/3 |
| 4,936,206 | 6/1990 | Miles et al. | 100/3 |

FOREIGN PATENT DOCUMENTS

| | | | |
|---|---|---|---|
| 0198992 | 10/1986 | European Pat. Off. | 100/193 |

*Primary Examiner*—Stephen F. Gerrity
*Attorney, Agent, or Firm*—Cort Flint

[57] ABSTRACT

An apparatus and method for producing strapped bales of highly compressible textile fibers is disclosed. The apparatus includes a supply chamber for supplying loose fibers to a tramping chamber which is stationary. A ram assembly repeatedly tramps loose fibers to form a compacted fiber mass which is then formed into a compressed fiber block within a stationary compression chamber disposed in fiber transfer relation to the stationary tramping chamber. The stationary tramping and compression chambers are off-set and the fiber mass is transferred through a transfer opening into the compression chamber. During the compression cycle, a new fiber mass may be tramped in the tramping chamber allowing a high production rate of strapped fiber bales. The compressed fiber block is formed between a movable main platen and a movable secondary platen which are axially aligned in the compression chamber. After compression, the compressed fiber block may be transferred into an alignment with a strapping and ejection opening in the strapping section also coaxial with the compression chamber.

23 Claims, 10 Drawing Sheets

METHOD AND APPARATUS FOR PRODUCING A STRAPPED BALE OF COMPRESSED FIBERS

BACKGROUND OF THE INVENTION

This invention relates to the production of a strapped bale of compressed textile fibers at a high rate yet without the need of an arrangement having a large number of moving parts, in particular the invention relates to an apparatus and method wherein tramping and compressing of fibers may be carried out simultaneously without the need to rotate the tramping and compressing chambers.

In the baling of cotton and other fibers, an apparatus commonly used, referred to as a "double-lift box baler" employs a pair of lift boxes mounted side-by-side on a turntable. The boxes are rotated on the turntable between a charging position and a compression position at which the respective boxes are positioned beneath a fiber tramping assembly and a fiber compression ram assembly. During the charging and tramping cycle, the box is repeatedly filled and tramped while successive deposits of fibers are held in place by fiber retaining dogs. Once the box is filled, it is rotated to the compression position. While the fibers in the lift boxes are being tramped and compressed, the turntable rests on a bottom sill across the full width of the bales to withstand the compression forces. After the bale is compressed and removed from the baler, it is necessary to lift the turntable and lift boxes. This rotation and lifting operation requires a relatively complicated lifting mechanism and substantial power to lift the turntable and lift boxes during rotation. Previously, this has resulted in very complicated lifting mechanisms and balers wherein the reliability of the baler is comprised due to repeated rotation and lifting motions of the turntable and lift boxes.

In addition, with the advent of higher production textile equipment and lines, it is desirable to provide fiber balers which are less complicated and more reliable, and provide higher production rates as well.

U.S. Pat. No. 2,209,740 discloses a cotton gin press of the double-lift box type having a plurality of dogs which retain the cotton as it is rotated in a filling box on a turntable to a press ram structure. Considerable problems are involved with utilizing a turntable-type filling and baling apparatus in connection with baling textile fibers, and in particular, with forming a strapped bale of compressed fibers. In filling a filling box, it is known to fill and tramp compressible cotton fibers repeatedly in order to completely fill the box prior to rotation to the main press box.

U.S. Pat. No. 4,162,603 discloses a method and apparatus for pressing voluminous material into bales. The material is formed into several layers and then supplied to a closable opening into a pressing chamber where compression takes place of each supplied layer. Final pressing is carried out at high pressure after a desired number of layers has been supplied into the pressing chamber. After the high pressure is applied to the layers of material, the pressure is lowered so that the compressed material is permitted to expand. The bale is then discharged from the pressing chamber and bound outside of the pressing chamber while the lower pressure is maintained. The transfer of the material takes place laterally from one chamber to another by use of various moveable walls. Complicated structure is required to eject the expanded bale from the compression chamber and to fold sheet material over the sides of the bale, usually in the form of laminated, polyethylene fabric. The method requires a large number of steps since the material is fed to the pre-pressing chamber in the form of stacked layers before the material is transferred to the final compression chamber. The method further comprises additional steps in the compression chamber where three or more packings of the pre-pressed material are used in the final compression.

Accordingly, an object of the present invention is to provide a method and apparatus for producing strapped bales of compressible fibers.

Another object of the present invention is to provide a method and apparatus for producing strapped bales of compressible fibers at a high rate of production which does not use rotating lift boxes.

Another object of the invention is to provide a method and apparatus for producing strapped bales of compressed fibers at a high rate of production wherein the stages of the production may be carried out simultaneously in the method and apparatus so that while one stage is being performed on the fibers, another stage may be ongoing to assure a high rate of production without the need to rotate lift boxes.

Yet another object of the present invention is to provide a commercial process and apparatus for producing strapped bales of compressed fibers which requires a minimum of moving parts so that a high rate of reliable commercial production and safety to operator may be had.

SUMMARY OF THE INVENTION

The above objectives are accomplished according to the invention by providing an apparatus and method for producing a strapped bale of compressed fibers. The apparatus includes a fiber supply of loose compressible fibers, a tramping chamber for receiving the loose fibers, a reciprocating platen disposed within the tramping chamber for repeatedly tramping successive deposits of loose fibers to create a compacted fiber mass during a tramping cycle. A controller actuates the reciprocating platen repeatedly during the tramping cycle until a compacted fiber mass is formed containing a prescribed amount of fibers. A plurality of retaining elements are operatively associated with the tramping chamber for retaining the compacted fibers within the tramping chamber while the successive deposits of the loose fibers are compacted to produce the compacted fiber mass. A compression chamber contains a compacted fiber mass which includes a compression section in which the compacted fiber mass is compressed in the same direction in which the loose fibers are compacted to produce a compressed fiber block during a compression cycle.

In a preferred embodiment, the tramping chamber and the compression chamber are advantageously laterally off-set from each other to increase the production rate. The off-set tramping chamber and compression chamber are stationary, and are in open fiber transfer relation with each other through a transfer opening. At least one reciprocating transfer plate is provided for transferring the compacted fiber mass from the tramping chamber to the compression chamber. The transfer plate forms a wall of the compression chamber during the compression cycle. A moveable main platen is reciprocally carried in the compression chamber and a moveable secondary platen is carried in alignment with the main platen. The main platen and secondary platen compress the compacted fiber mass between a compression position of the main platen and a spaced compression position of the secondary platen to form the compressed fiber block. The compression section is defined between the main platen and secondary platen when located at the compression positions during the compression cycle. The compression section is defined in a portion of the compression chamber spaced from a bale strapping and ejection section. Advantageously, the main and secondary platens are horizontal to form top and bottom platens. The main platen and secondary platen move in unison to transfer the compressed fiber block from the compression section to an alignment with the strapping and ejection section. The main platen is disposed at the compression position in the compression chamber during the strapping and ejection cycle to form a wall of the tramping chamber so the tramping cycle may continue during the ejection cycle.

According to the invention, a method is provided for producing a strapped bale of compressed fibers wherein loose compressible fibers are supplied. The method includes tramping the loose fibers to create a compacted fiber mass of loosely compacted fibers, and retaining the fiber mass within a tramping chamber while successive deposits of the loose fibers are supplied and compacted in the compacted fiber mass to produce a compacted fiber mass containing a prescribed amount of fibers during a tramping cycle. Next, the compacted fiber mass is compressed mass within a compression chamber in the same direction the fiber mass is tramped to create a compressed fiber block during a compression cycle.

In a preferred embodiment, the compacted fiber mass is formed by tramping the loose fibers in a tramping chamber generally parallel to and laterally off-set from a compression section in which the compressed fiber block is formed. The compacted fiber mass is compressed using a moveable main platen and a moveable bottom platen, and the method includes compressing the compacted fiber mass between a bottom position of the main platen and a top position of the bottom platen in the compression section above the ejection chamber. Next, the method includes moving the compressed fiber block in the compression chamber by moving the main platen and bottom platen in unison and aligning the compressed fiber block with an ejector opening of the strapping and ejection section which is axially aligned with the compression chamber.

The method of producing a strapped bale of compressible textile fibers in stationary, laterally off-set tramping chamber and compression chambers quite advantageously includes the sequence of supplying looser fibers to the tramping chamber, extending the tramping plate to compact the loose fibers and form a compacted fiber mass during a tramping cycle, retracting the main platen after the tramping cycle, and transferring the compacted fiber mass from the tramping chamber to the compression chamber. Next, the method includes extending the main platen to compress the compacted fiber mass in the compression chamber to form a compressed fiber block during a compression cycle. Next, the method includes strapping and ejecting the strapped compressed fiber bale through an ejection opening. Next, the method includes maintaining the main platen to form a wall of the tramping chamber and close the transfer opening to commence a tramping cycle during the strapping and ejection cycle.

In accordance with another advantageous embodiment of off-set stationary tramping and compressing chamber, the method includes providing a secondary movable platen in axial alignment with the main platen and moving the secondary platen to a transfer position adjacent the transfer opening in the compression chamber. The method includes transferring the fiber mass to a position between the main platen and secondary platen in the compression chamber, and compressing the fiber mass between the main and secondary platens to form a compressed fiber block. Next, the method includes moving the main platen and secondary platen together in unison to position the compressed fiber block in the compression chamber into alignment with an ejection opening of the ejection sleeve through which the compressed fiber block is ejected transversely from the compression chamber. Next, the method includes extending the ejector platen to eject the fiber block, closing an opening to the compression chamber by moving a shelf door in unison with the ejector platen, and retracting the main platen to form a wall of the tramping chamber and resume the tramping cycle.

DESCRIPTION OF THE DRAWINGS

The construction designed to carry out the invention will hereinafter be described, together with other features thereof.

The invention will be more readily understood from a reading of the following specification and by reference to the accompanying drawings forming a part thereof, wherein an example of the invention is shown and wherein.

DESCRIPTION OF A PREFERRED EMBODIMENT

Referring now in more detail to the drawings, a method and apparatus for producing a strapped bale of compressed fibers is illustrated.

Figure 1:
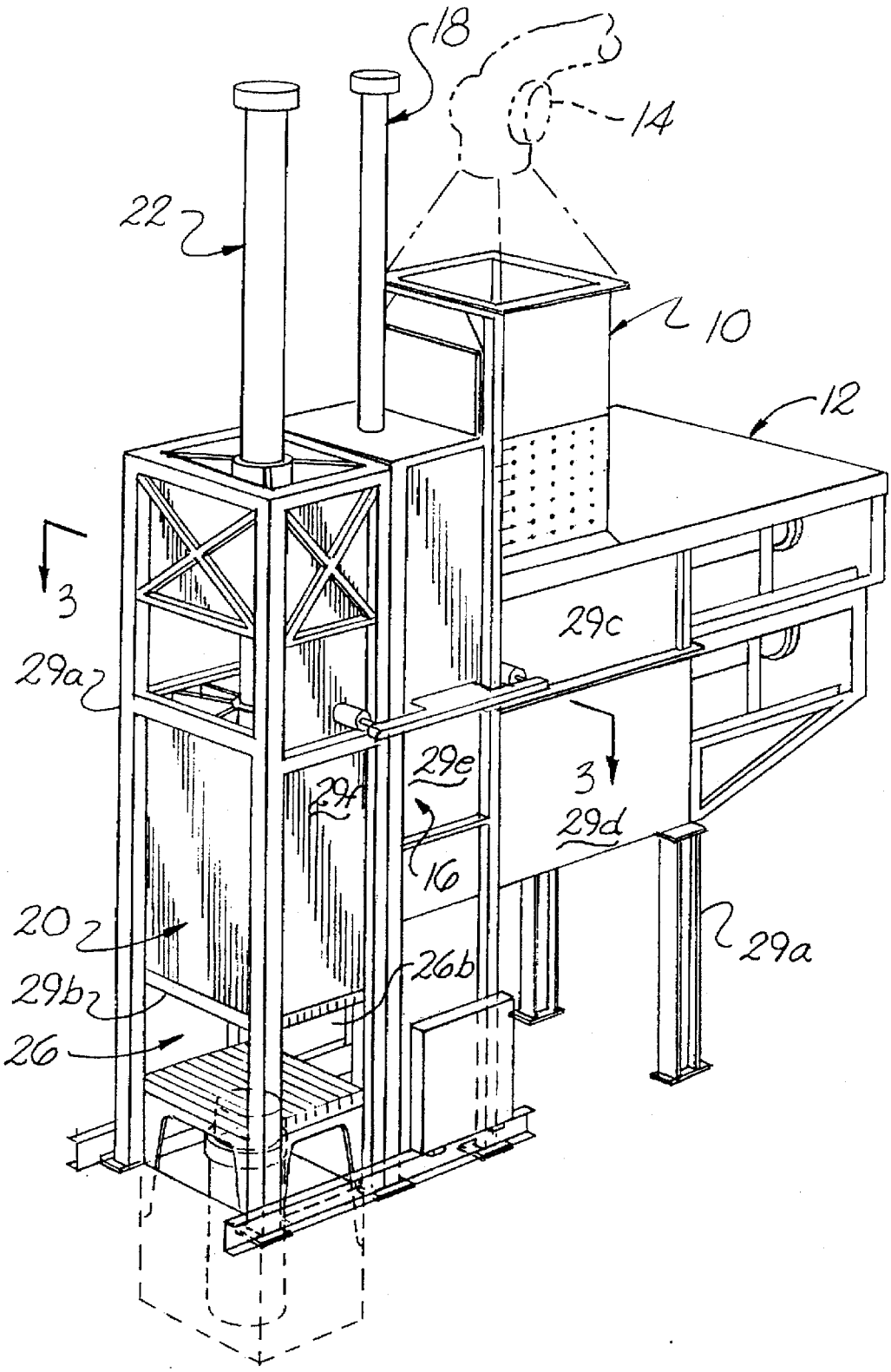
FIG. 1 is a perspective view illustrating an apparatus and method for producing a strapped bale of compressible fibers according to the invention.

As can best be seen in FIG. 1, an embodiment of the invention is illustrated wherein a fiber baler, designated generally as A, is illustrated which includes a supply chamber, designated generally as 10 and a fiber pusher section designated generally at 12. Loose fibers F are conveyed to supply chamber 10 by any suitable means such as a pneumatic conveyor, illustrated at 14, direct outer drop, or belt conveyor. Loose fibers from the fiber pusher chamber are pushed into a tramping chamber, designated generally as 16. In the tramping chamber, the loose fibers are formed into a compacted fiber mass by a tramper assembly, designated generally as 18. The compacted fiber mass is received in a compression chamber, designated generally as 20, where the compacted fiber mass is compressed into a fiber block by a main ram assembly, designated generally as 22. Finally, the compressed fiber block is strapped and ejected from a strapping and ejection section 26.

Figure 2:
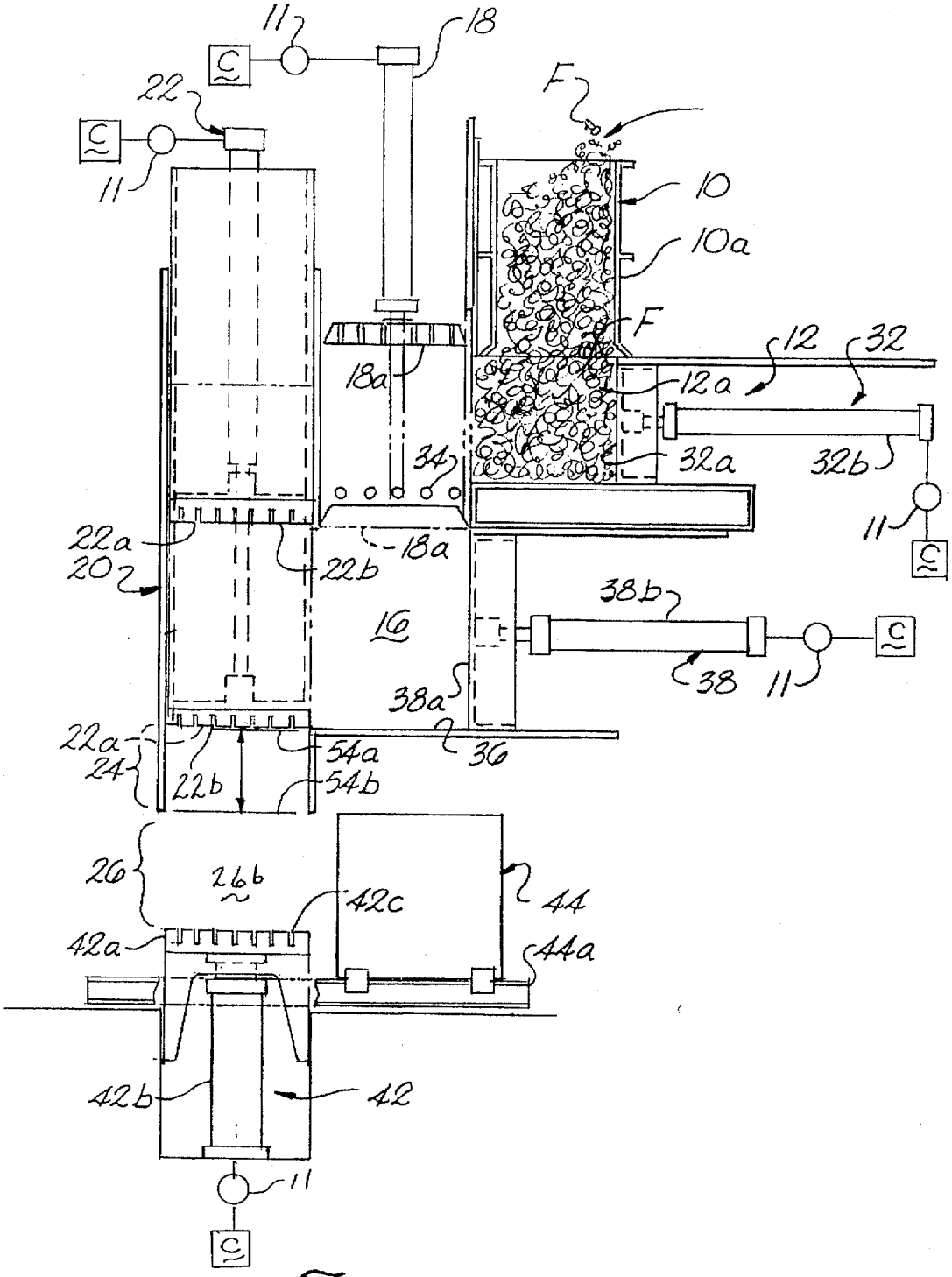
FIG. 2 is a schematic side elevation illustrating the internal processing chambers of an apparatus and method for producing strapped bales of compressible fibers as shown in FIG. 1.
Figure 3:
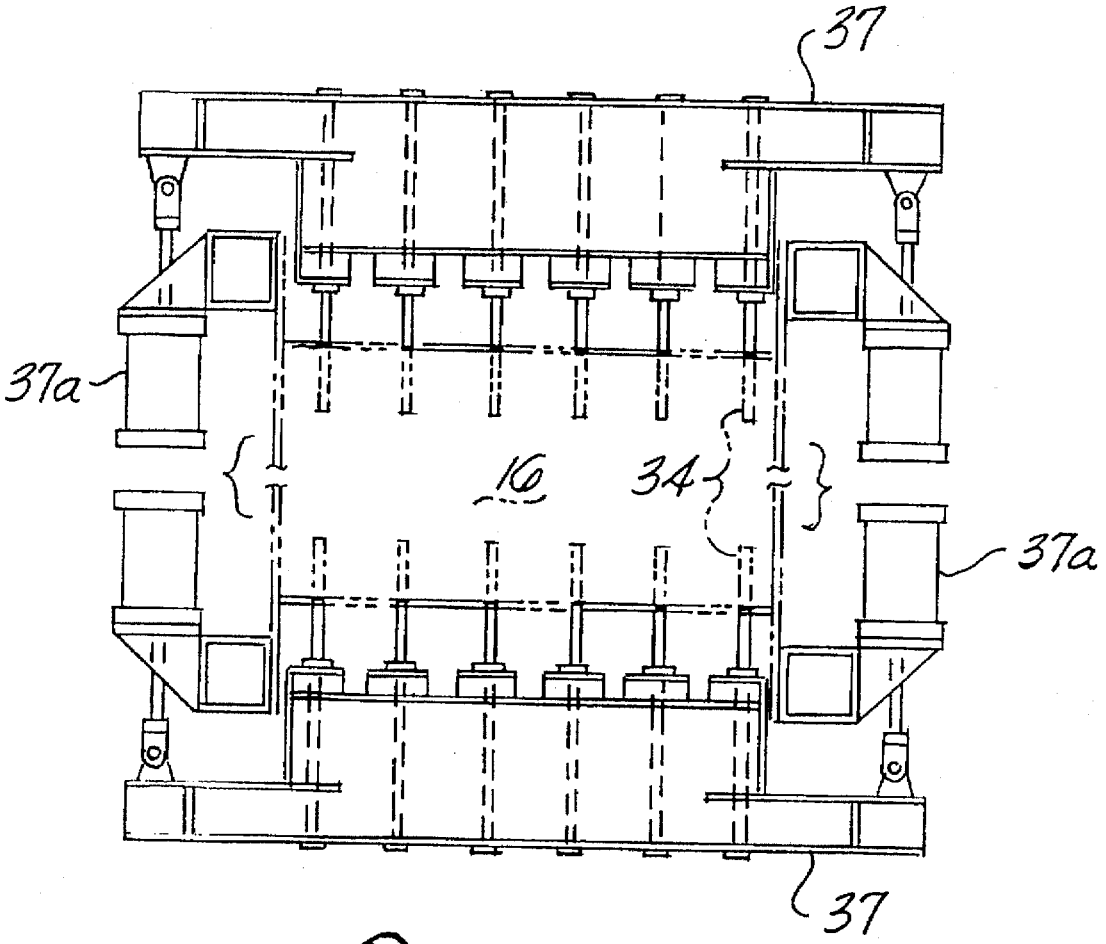
FIG. 3 is a section view taken along Line 3—3 of FIG. 1.

Referring now in more detail to FIG. 2, the method and apparatus will be more fully described, wherein loose fibers F pneumatically conveyed or by gravity, are deposited in a condenser, or air separation unit, having a screen section 10*a* from which air escapes as shown by the arrows to deposit the loose fibers into chamber 12*a* where they are pushed forward into tramping chamber 16 by means of a fiber pusher assembly, designated generally as 32, which includes a fiber pusher plate 32*a* and a ram cylinder 32*b* connected to a suitable source of hydraulic fluid by which the ram is actuated. Fibers are pushed into the tramping chamber 16 which includes a plurality of fiber retaining elements 34 (FIG. 3) which retain the fibers after being pushed past the retaining elements by a tramping plate 18*a*, such as a webbed tramping foot or platen, having a slot opening to relieve the air on the tramping stroke, which forms part of the tramping assembly 18. Plate 18*a* is reciprocated by a tramping ram cylinder 18*b* connected to a suitable source of hydraulic fluid by which it is actuated. An effective tramping chamber is defined between retaining elements 34 and an opposing wall 36 in which the fibers are formed into a compacted fiber mass. Successive deposits of loose fibers will be pushed into the tramping chamber and tramped by plate 18*a* until a compacted fiber mass having a prescribed amount of fibers, or a prescribed weight, is formed. For these purposes, fiber retaining elements 34 may be provided in the form of a plurality of dogs 34 carried on opposing sides of the tramping section as can best be seen in FIG. 3 wherein a plurality of dogs 34 are carried on rails 37 and reciprocated in and out of the chamber by means of hydraulic or air actuators 37*a*. The extension and retraction of the dogs into and out of the chamber may be controlled in a conventional manner so that the dogs are retracted when the tramping plate is extended, and the dogs are extended when the tramping plate has been retracted past the dogs.

Figure 5:
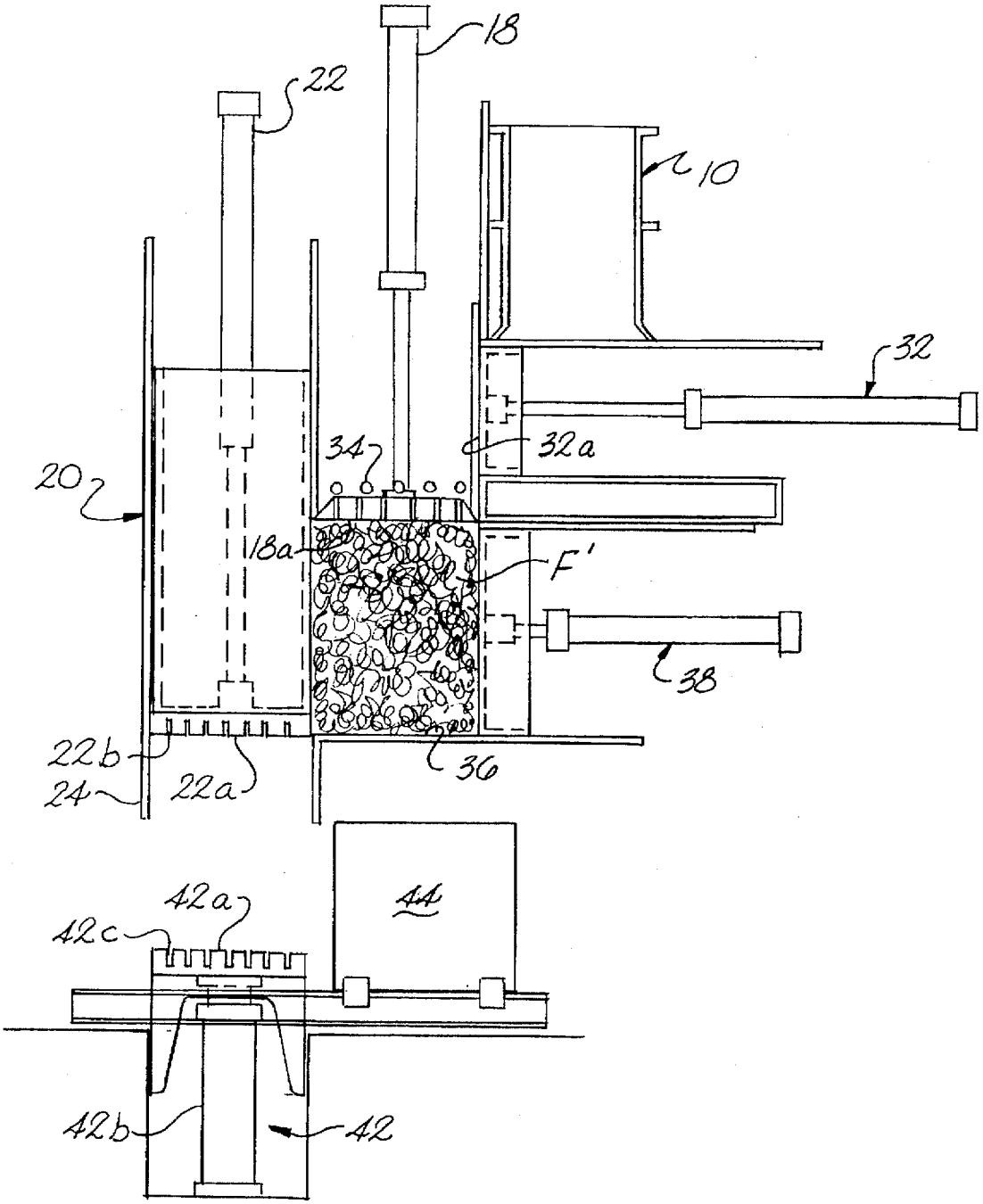
Figure 6:
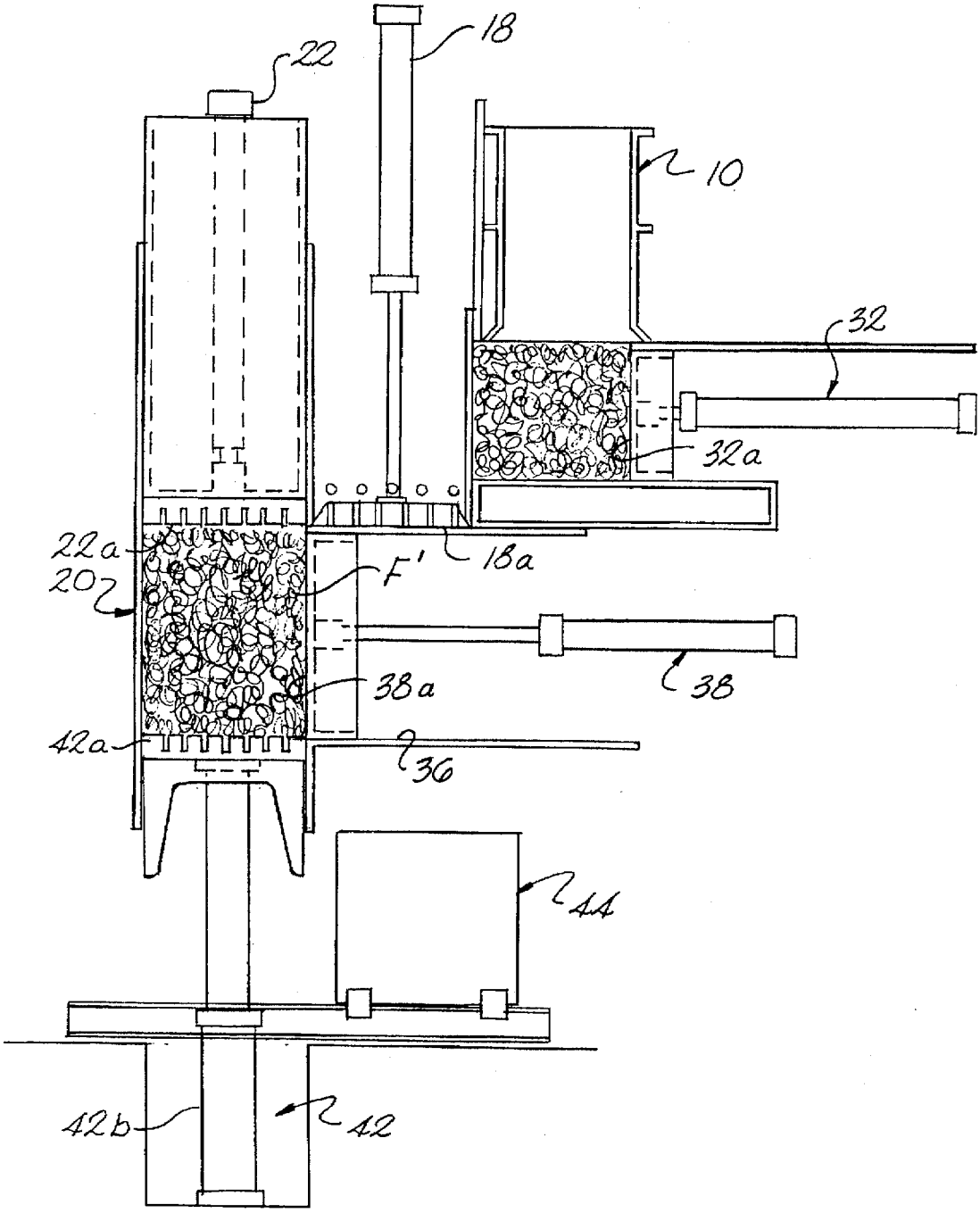

After the compacted fiber mass is formed containing the prescribed amount of fibers, a transfer plate assembly 38 is actuated so that a transfer plate 38*a* is moved to the left by a ram cylinder 38*b* to transfer the fiber mass into compression section 24. During the supply and tramping cycles, it is noted that the supply and tramping of fibers in chamber 16, it is noted that a platen 22*a* of main platen assembly 22 is moved to a position adjacent bottom wall 36 of the tramping chamber so that a rectangular shroud 22*b* which forms part of the platen assembly, acts as a wall of the tramping chamber (FIGS. 5 and 6). The opposing wall is provided by transfer plate 38*a*, and the remaining side walls are provided by stationary side plates of a unitary frame which completes the enclosure. During the transfer cycle, tramping plate 18*a* is extended to the position shown in FIGS. 5 and 6 to form a top of the tramping/transfer chamber. The tramping plate has a home position shown in solid lines in FIG. 2.

Compression chamber 20 includes compression sections 24 coaxial with strapping section 26, and preferably spaced above. The bottom of the compression chamber is provided by a movable bottom or secondary platen assembly, designated generally as 42, which includes a movable bottom platen 42*a* and a bottom ram cylinder 42*b* connected to a suitable source of hydraulic fluid for actuation. Compression section 24 is defined between lines 54*a* and 54*b* which also define compression positions for main platen 22*a* and secondary platen 42*a*, as will be discussed in their operation.

Strapping and ejection section 26 includes an ejection opening 26*b* formed in the frame of compression chamber 20 through which the completed, strapped bale may be ejected or removed from either side of the compression chamber or strapping section. The main and secondary platens in the compression chamber include strap notches 22*b*, 42*c*, respectively for applying straps around the bale. The straps may be placed around the bale in a conventional manner such as manually or by using a conventional automatic strapping machine shown schematically at 44. Automatic strapping machine 44 may be carried on rails 44*a* for movement between an operative position (FIG. 8) in which it automatically places the straps "S" about the bale and an inoperative position, (FIG. 2) in which the automatic baling machine is moved away from the ejection opening 26*b* for ejection of the finished bale. As can best be seen in FIGS. 9C, 9B, secondary platen 42*c* includes at least one ejector element in the form of a pivotal plate 45 which can be actuated by a fluid cylinder 45*a* at the appropriate time to eject the finished bale either to the right (FIG. 9B) or to the left. If it is desired to eject the bale to the left, then a pivot pin 45*b* of ejector plate 45 is moved to the left side as well as a return spring 45*c*. In this manner, the completed, strapped bale may be ejected from either side of the baler. After the bale has been strapped, it is to be understood that main platen 22*a* is retracted for ejection of the completed bale.

So that the supply and tramping cycles may continue during the ejection cycle, it is desired that main platen plate 22*a* return to position 54*a* in FIG. 2 once the ejector platen closes off opening 44. Main platen 22*a* is retracted to its home position only at the beginning of a transfer cycle when fiber mass F' is being transferred to the compression chamber.

It will be understood that the various chambers so described are rectangular and that the remaining portions of the enclosures not described, will, in addition, to the described movable plates and platens be apparent to those skilled in the art having been taught the expedients of the invention. A unitary frame, designated generally as 29, is provided for supporting and including the various extension sides and bottom plates needed to finish the enclosures, and the various movable platens and plates. Among other like members, the unitary frame includes various vertical and horizontal frame legs 29*a*, 29*b*. Various outer walls or plates generally include supply chamber outer walls 29*c*, transfer chamber outer walls 29*d*, tramping chamber outer walls 29*e*, and compression chamber outer walls 29*f*.

Figure 4:
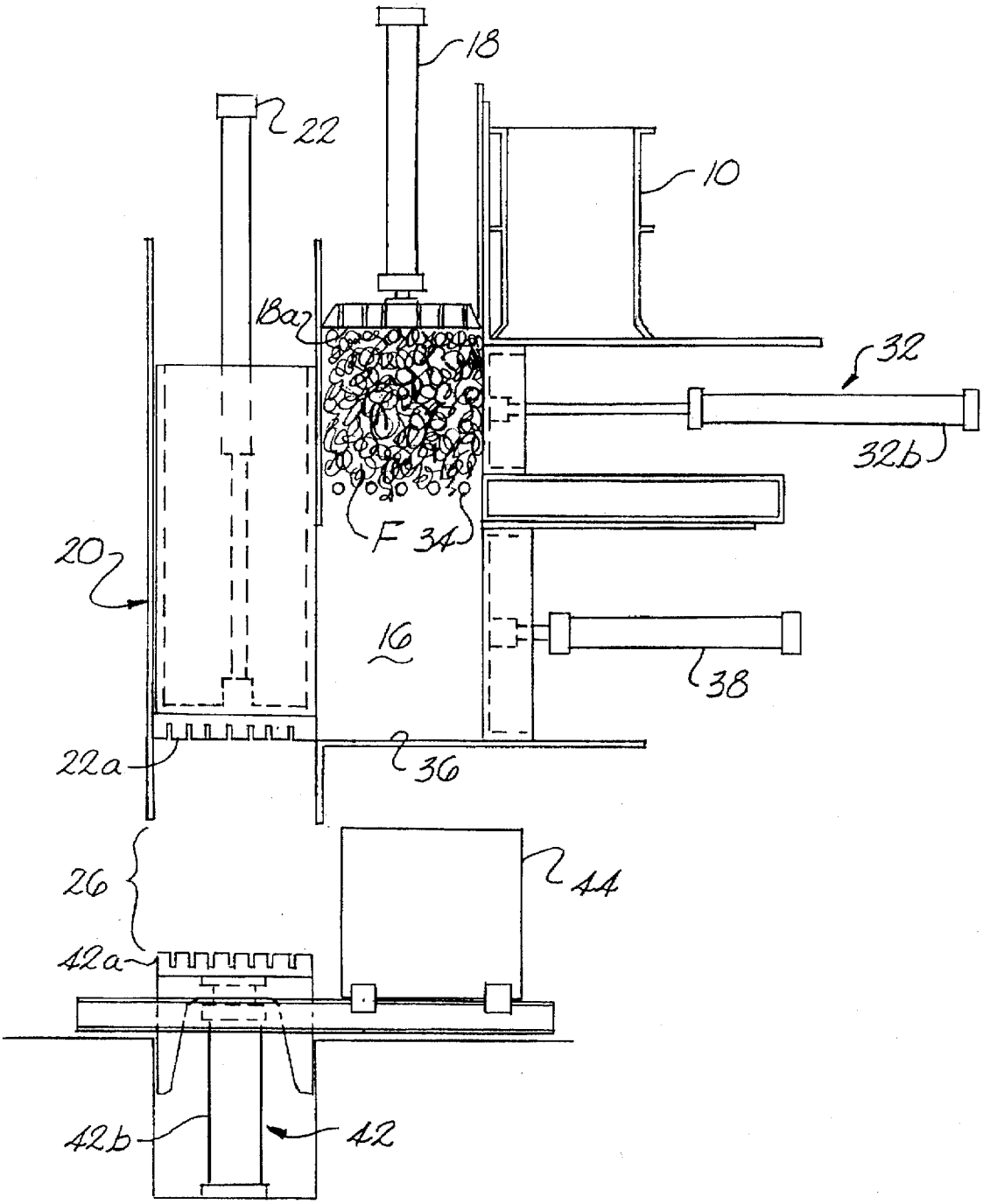
FIGS. 4–9B are schematic illustrations of the various processing chambers and supply, tramping, compression, and strapping and ejection cycles of an apparatus and method for producing strapped bales of compressible fibers according to the invention.

Having had an understanding of the various chambers in which the fibers are processed, and the various movable plates and platens which process the fibers, the operation and method of the present invention will now be described in more detail. First, referring to FIG. 9A, an example of a compressed fiber bale 50, approximately 21"×55", made in accordance with the invention will be referred to. While the dimensions of the various rectangular chambers and ejection sleeve may vary, one embodiment is illustrated in FIG. 4 for purposes of illustration and example. In the illustrated embodiment of FIG. 9A, strapping and ejection section 26, for example, may have an interior height of thirty-two inches and a width of approximately twenty-one inches.

OPERATION

Referring now to FIGS. 4 through 9C, the operation and method of the above embodiment of the invention now be described in more detail. FIGS. 4 through 5 illustrate the supply and tramping cycles wherein loose fibers F are formed into a compacted fiber mass F'. During the supply and tramping cycles, main platen 22*a* is at its intermediate position, as shown. Successive deposits of fibers F are pushed from supply chamber 12 into tramping chamber 16 by pusher plate 32*a* (FIGS. 2 and 4). Next, tramper plate 18*a* compacts the fibers into compacted fiber mass F' (FIG. 5). Upon retraction of the tramping plate, the fibers are retained by dogs 34. The process is repeated until the desired quantity of fibers are obtained in compacted fiber mass F'.

Figure 7:
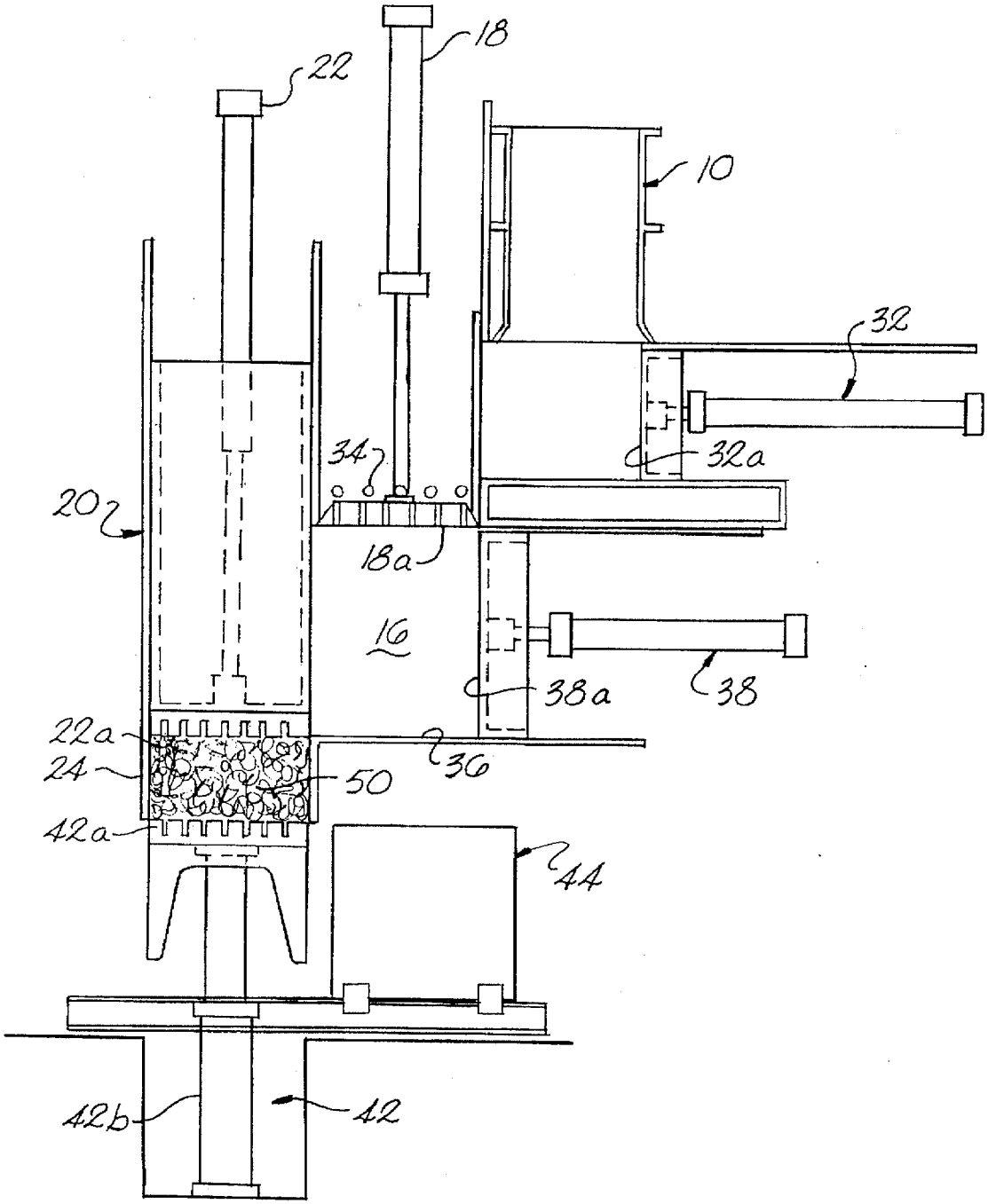
Figure 8:
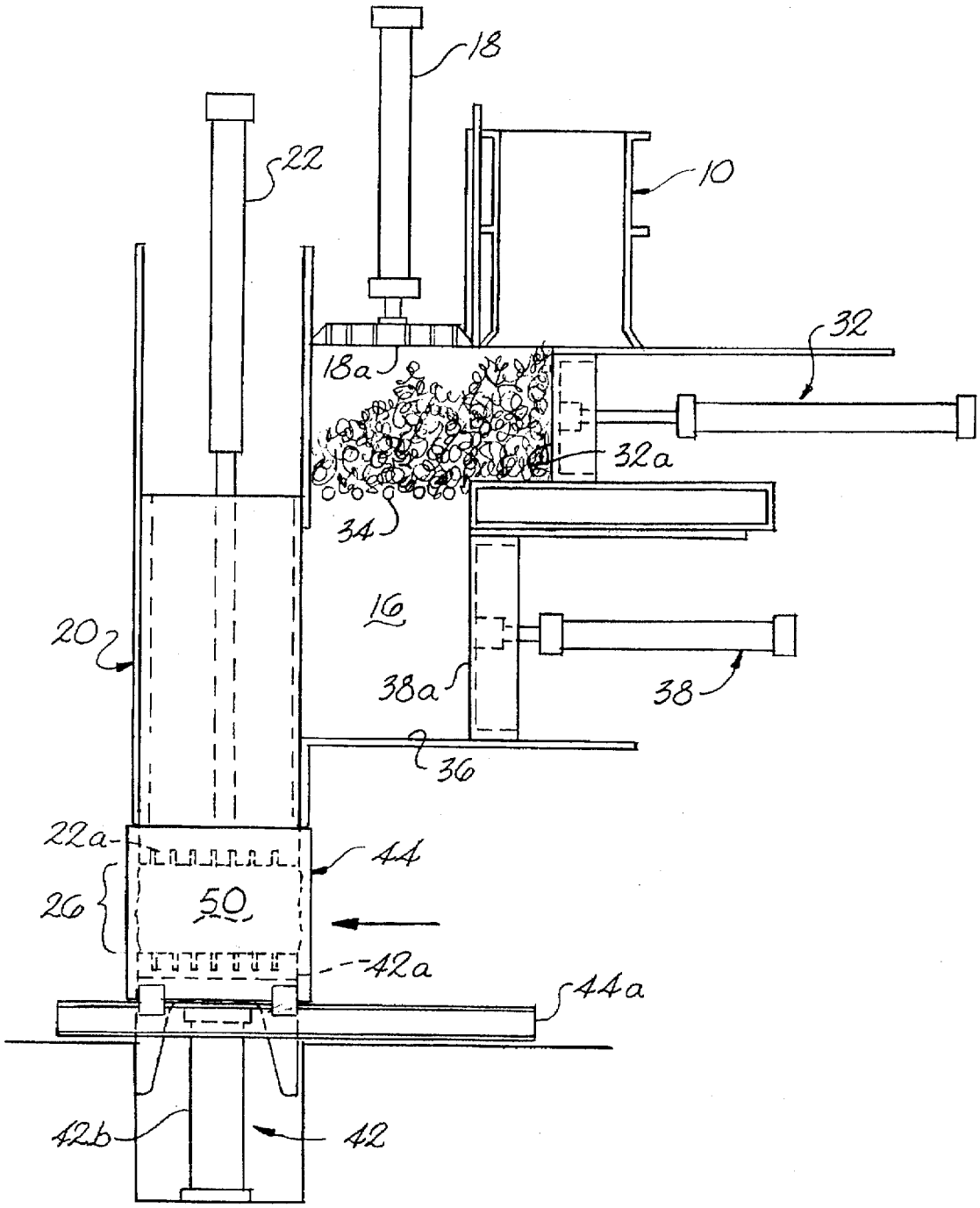

FIGS. 6 and 7 illustrate the transfer and compression cycles. In FIG. 6, compacted fiber mass F' is transferred from the tramping chamber 16 into compression chamber 20. Prior to the transfer, movable bottom 42*a* is extended to a top position, as shown in FIG. 6, level with tramping chamber floor 36. Main platen 22*a* remains at its home, fully retracted position. The compacted fiber mass is then transferred into the compression chamber. Transfer plate 38*a* stays in its extended, transfer position to form a wall of the compression section. With the fiber compacted mass confined between the bottom platen and the main platen, the two platens begin a synchronized, downward movement to strapping section 26. Main platen 22*a* and bottom platen 42*a* move together until bottom platen 42*a* reaches position 54*b*, then main platen 22*a* continues forward to compress the bale between positions 54*a* and 54*b* in compression section 24. After compression, both platens 22*a*, 42*a* move in unison until compressed bale 50 is moved into strapping and ejection section 26*b*. The compressed bale is held between the two platens in front of the ejection opening 26*a*. Straps "S" are then placed about the compressed bale manually or by automatic baling machine 44 (FIGS. 8 and 9A).

Figure 9A:
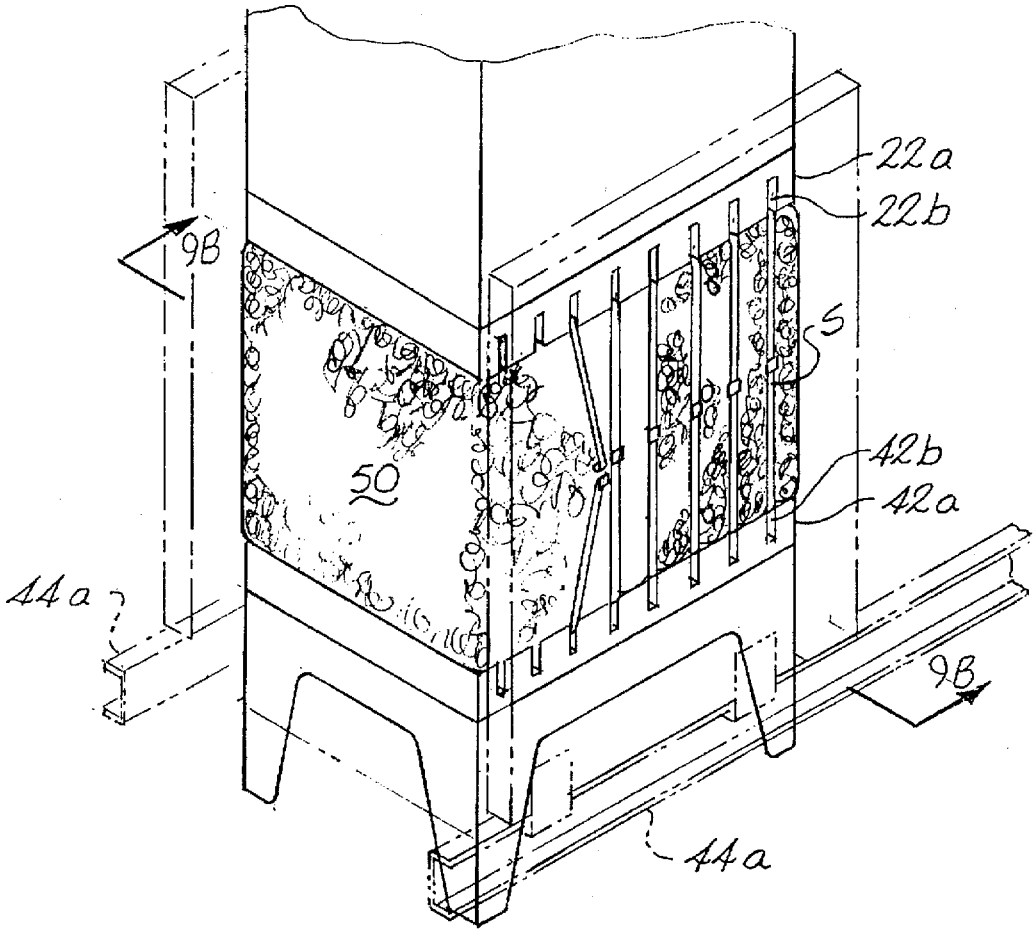
FIG. 9C is a perspective view of a strapping and ejection section and method of the baler of FIG. 1 illustrating the ejection of a strapped fiber bale.
Figure 9C:
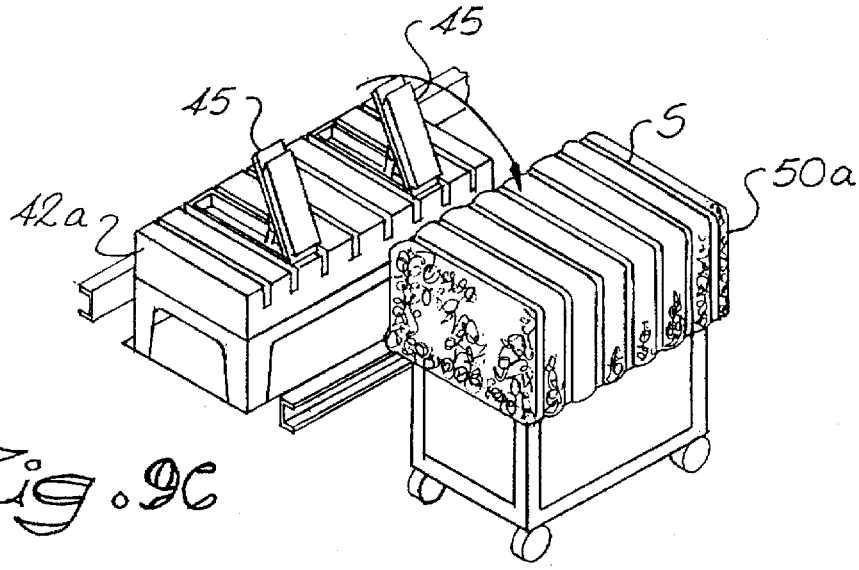
Figure 9B:
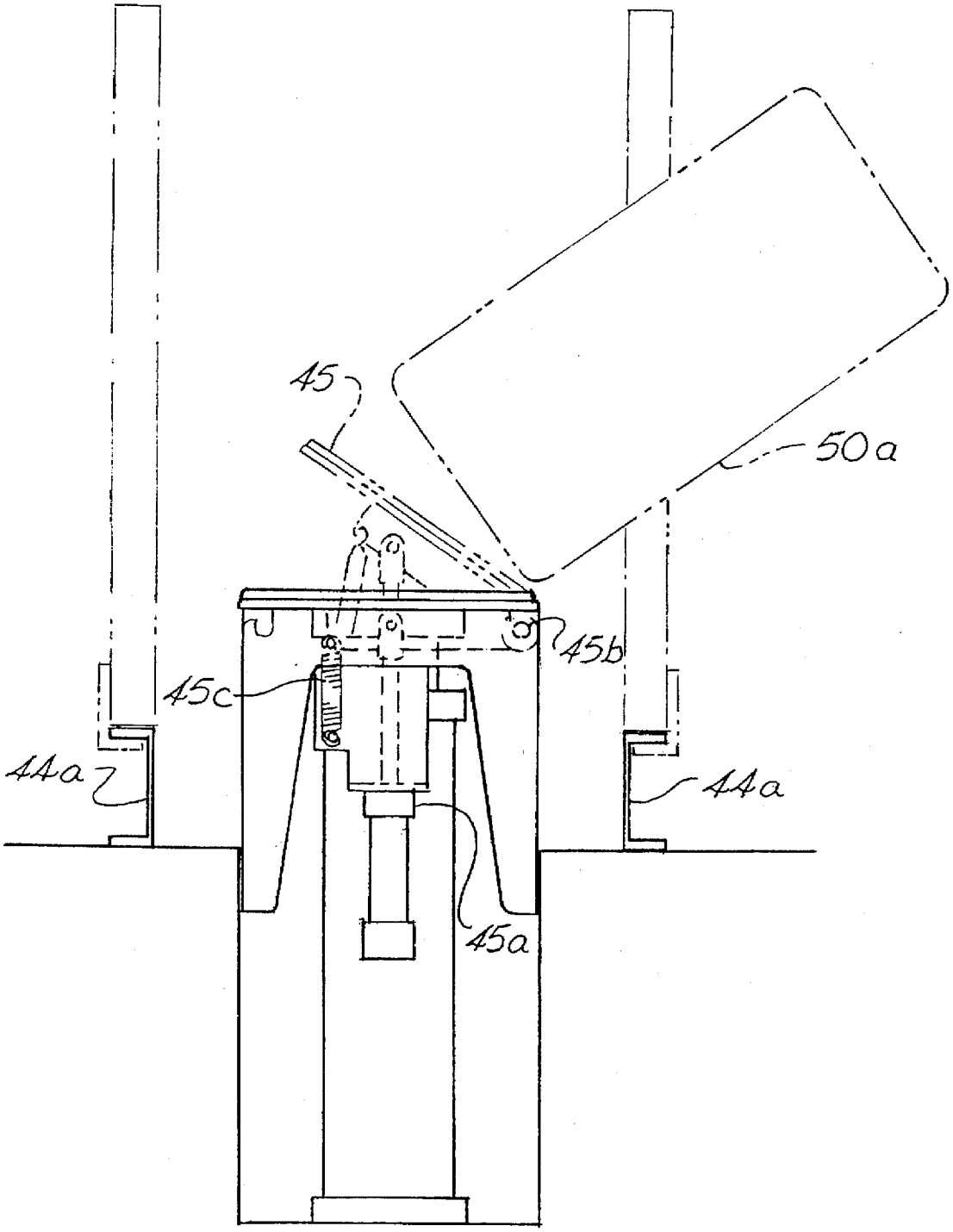

Referring now to FIGS. 9A through 9C, the ejection cycle will be described. After strapping and prior to the beginning of the ejection cycle, main platen 22*a* is retracted to position 54*a* so tramping may resume. The supply, tramping, and transfer cycles may continue so that the formation of a compacted fiber mass F' may again proceed as described above. After another compacted fiber mass is formed, ejector platen 22*a* will be retracted to its home position and the compacted fiber mass may be transferred, compressed, and ejected, as described above. The normal operation for a complete cycle is about 2 minutes.

A high production rate for strapped bales is provided by the offset tramping and compression chambers which allows the tramping of a new fiber mass while the previous fiber mass is compressed and ejected without the need to rotate and lift boxes.

While a preferred embodiment of the invention has been described using specific terms, such description is for illustrative purposes only, and it is to be understood that changes and variations may be made without departing from the spirit or scope of the following claims.

What is claimed is:

1. Apparatus for producing a strapped bale of compressible fibers comprising:

a fiber supply for supplying loose compressible fibers;

a tramping chamber for receiving said loose fibers;

a reciprocating tramping platen disposed within said tramping chamber for repeatedly tramping successive deposits of loose fibers to create a compacted fiber mass during a tramping cycle;

a controller for actuating said reciprocating platen repeatedly during said tramping cycle until a compacted fiber mass is formed containing a prescribed amount of fibers;

a plurality of retaining elements operatively associated with said tramping chamber for retaining said compacted fibers within said tramping chamber while said successive deposits of said loose fibers are compacted to produce said compacted fiber mass;

a compression chamber for receiving said compacted fiber mass which includes a compression section in which said compacted fiber mass is compressed in the same direction in which said loose fibers are compacted to produce a compressed fiber block during a compression cycle;

said tramping chamber and said compression chamber being parallel but laterally off-set from each other, a transfer opening between said off-set tramping chamber and compression chamber for transfer of said compacted fiber mass;

a strapping section axially aligned with said compression chamber in which straps are placed about said compressed fiber block for forming a strapped fiber bale; and an ejector associated with said strapping section for ejecting said strapped fiber bale from an ejection opening of said strapping section in a direction transverse to the direction of compression.

2. The apparatus of claim 1 including a moveable main platen reciprocally carried in said compression chamber and a moveable secondary platen carried in alignment with said main platen, said main platen and secondary platen compressing said compacted fiber mass between a compression position of said main platen and a spaced compression position of said secondary platen to form said compressed fiber block.

3. The apparatus of claim 2 wherein a compression section is defined between said main platen and secondary platen when located at said compression positions during said compression cycle.

4. The apparatus of claim 3 wherein said main platen and secondary platen have a transfer position in which said compressed fiber block is transferred from said compression section to said strapping section.

5. The apparatus of claim 1 including strapping means displaceably carried near said strapping section which has an operative position for strapping said bale and an inoperative position in which said strapped bale may be ejected from said ejection opening.

6. Apparatus for producing a strapped bale of compressed fibers comprising:

a fiber supply of loose fibers;

a stationary tramping chamber for receiving said loose fibers;

a reciprocating tramping platen disposed within said tramping chamber for repeatedly tramping deposits of loose fibers to create a compacted fiber mass during a tramping cycle containing a prescribed amount of fibers;

a stationary compression chamber in which said compacted fiber mass is compressed in the same direction in which said loose fibers are compacted to produce a compressed fiber block during a compression cycle;

a reciprocating main platen for compressing said fibers in said compression section;

said tramping chamber and said compression chamber being generally parallel and laterally off-set from each other, and a fiber transfer opening being defined between said off-set tramping chamber and compression chamber;

a reciprocating transfer plate for transferring said compacted fiber mass from said tramping chamber to said compression section;

a moveable main platen reciprocally carried in said compression chamber and a moveable secondary platen carried in alignment with said main platen, said main platen and secondary platen compressing said compacted fiber mass between a compression position of said main platen and a compression position of said secondary platen to form said compressed fiber block; and a strapping section at which straps are placed about said compressed fiber block to form a strapped fiber bale, and an ejection opening through which said strapped fiber bale is ejected from said strapping section during an ejection cycle.

7. The apparatus of claim 6 including an ejector associated with said strapping section for ejecting said compressed fiber block from said compression chamber.

8. The apparatus of claim 6 wherein a compression section is defined between said main platen and secondary platen at said compression positions in which said fiber mass is compressed during said compression cycle.

9. The apparatus of claim 8 wherein said main and secondary platens are arranged along a vertical axis, and said compression section is defined in a portion of said compression chamber above said strapping section.

10. The apparatus of claim 6 wherein said main platen and secondary platen move in unison to transfer said compressed fiber block to a strapping section generally in alignment with said ejection opening of said strapping section.

11. The apparatus of claim 6 including a plurality of retaining elements operatively associated with said tramping chamber for retaining said compacted fibers within said tramping chamber while said successive deposits of said loose fibers are compacted to produce said compacted fiber mass.

12. A method for producing a strapped bale of compressible fibers comprising:

supplying loose fibers;

tramping said loose fibers in a stationary tramping chamber to create a compacted fiber mass of a predetermined amount of loosely compacted fibers during a tramping cycle;

transferring said compacted fiber mass through a transfer opening to a stationary compression chamber which is laterally off-set and generally parallel to said tramping chamber;

compressing said compacted fiber mass using a moveable main platen which moves axially in said compression chamber, and a co-axial moveable bottom platen, and compressing said compacted fiber mass in a compression section between a bottom position of said main platen and a top position of said bottom platen;

placing straps around said compressed fiber block in a strapping section to form a strapped fiber bale; and ejecting said strapped fiber bale from said strapping section during an ejection cycle.

13. The method of claim 12 including transferring said compacted fiber mass into said laterally off-set compression chamber by using a transfer plate which forms a wall of said compression chamber.

14. The method of claim 12 including confining said compressed fiber block between said main platen and said bottom platen; and moving said compressed fiber block by moving said main platen and bottom platen in unison and aligning said compressed fiber block with an ejection opening of said strapping section.

15. The method of claim 12 including ejecting said strapped fiber bale from said ejection opening by using an ejector carried by said lower platen.

16. The method of claim 12 including strapping said compressed bale by using an automatic strapping machine displaceable transversely alongside said strapping section.

17. The method of claim 12 including supplying and tramping said loose fibers in said tramping chamber while said main platen is in said bottom position forming a wall of said tramping chamber during said tramping cycle.

18. A method of producing a strapped bale of compressible textile fibers wherein loose compressible fibers are introduced into a tramping chamber through a supply opening and compacted into a fiber mass by a reciprocating tramping plate, and said compacted fiber mass is compressed to form a compressed fiber block by a reciprocating main platen in a compression chamber, wherein said method comprises:

providing a tramping chamber and a compression chamber which are generally parallel to and laterally off-set from each other wherein a transfer opening exists between said chambers for a direct fiber transfer;

supplying loose fibers to said tramping chamber;

extending said tramping plate to compact said loose fibers in said tramping chamber and form a compacted fiber mass during a tramping cycle;

transferring said compacted fiber mass from said tramping chamber to said compression chamber;

transferring said compacted fiber mass by extending a transfer plate transverse to the direction of tramping to move said compacted fiber mass laterally into said compression chamber; and maintaining said transfer plate in said extended position to form a wall of said compression chamber during said compression cycle;

extending said main platen to compress said compacted fiber mass in said compression chamber to form a compressed fiber block during a compression cycle;

placing straps around said compressed fiber block at a strapping section to form a strapped fiber bale;

ejecting said strapped fiber bale laterally from said strapping section.

19. The method of claim 18 including supplying successive deposits of loose fibers, repeatedly retracting said tramping plate while retaining said loose fibers in said tramping chamber; and repeating said supplying of said deposits, extending of said tramping plate, retraction of said tramping plate, and retaining of said compacted fibers until a compacted fiber mass is produced containing a prescribed amount of fibers during the tramping cycle.

20. The method of claim 19 including providing a secondary movable platen in axial alignment with said main platen, moving said secondary platen to a transfer position adjacent said transfer opening in said compression chamber, transferring said fiber mass to a position between said main platen and secondary platen in said compression chamber, and compressing said fiber mass between said main and secondary platens to form said compressed fiber block.

21. The method of claim 20 including moving said secondary platen to a compression position, and moving said main platen to a compression position in a compression section of said compression chamber which is axially aligned with said strapping section, and compressing said fiber mass into said fiber block in said compression section.

22. The method of claim 20 including moving said main platen and secondary platen together in unison in said compression chamber to position said compressed fiber block in alignment with an ejection opening of said strapping section through which said compressed fiber block is ejected transversely.

23. The method of claim 18 including retracting said extended transfer plate after said main platen is extended and closes said transfer opening, and resuming said tramping cycle.

* * * * *